US008002213B2

(12) United States Patent
Stehr

(10) Patent No.: US 8,002,213 B2
(45) Date of Patent: Aug. 23, 2011

(54) AGITATOR MILL

(75) Inventor: Norbert Stehr, Grünstadt (DE)

(73) Assignee: Büler AG, Uzwil (CH)

( * ) Notice: Subject to any disclaimer, the term of this patent is extended or adjusted under 35 U.S.C. 154(b) by 0 days.

(21) Appl. No.: 12/673,953

(22) PCT Filed: Aug. 17, 2007

(86) PCT No.: PCT/EP2007/007278

§ 371 (c)(1),
(2), (4) Date: Feb. 17, 2010

(87) PCT Pub. No.: WO2009/024158

PCT Pub. Date: Feb. 26, 2009

(65) Prior Publication Data

US 2011/0036935 A1 Feb. 17, 2011

(51) Int. Cl.
*B02C 17/16* (2006.01)

(52) U.S. Cl. ..... 241/171; 241/172

(58) Field of Classification Search ..... 241/171, 241/172

See application file for complete search history.

(56) References Cited

U.S. PATENT DOCUMENTS

| | | | |
|---|---|---|---|
| 5,333,804 | A | 8/1994 | Liebert |
| 5,566,896 | A | 10/1996 | Stehr et al. |
| 5,797,550 | A | 8/1998 | Woodall et al. |

FOREIGN PATENT DOCUMENTS

| | | | |
|---|---|---|---|
| DE | 4425832 | A1 | 2/1995 |
| DE | 4412408 | A1 | 10/1995 |
| EP | 0700723 | A | 3/1996 |
| EP | 0751830 | B1 | 2/2002 |

*Primary Examiner* — Mark Rosenbaum

(74) *Attorney, Agent, or Firm* — Browdy and Neimark, PLLC

(57) ABSTRACT

An agitator mill has a grinding vessel and an agitator shaft arranged such that it can be driven to rotate therein. Fixed at the end of the agitator shaft is a last agitator disc, on which is fixed a substantially cylindrical cage having apertures. Arranged inside the cage is a screening device. The distance between a second to last agitator disc and the last agitator disc is such that a braided flow forms, while avoiding a preliminary screening of grinding stock on one hand and auxiliary grinding bodies and coarse grinding stock particles on the other hand. Formed in the last agitator disc are passages through which the grinding stock passes together with the auxiliary grinding bodies, at which time a separation of the auxiliary grinding bodies and the coarse grinding stock particles takes place within the separating chamber formed by the last agitator disc and the cage. Formed in the last agitator disc are depressions that promote the formation of a braided flow between the last agitator disc and an adjacent agitator disc.

7 Claims, 9 Drawing Sheets

AGITATOR MILL

FIELD OF THE INVENTION

The present invention relates to an agitator mill comprising a grinding vessel that encloses a grinding chamber, into which a grinding stock inlet opens at one end and from which a grinding stock discharge port opens out at the other end, having an agitator arranged in the grinding chamber, said agitator having an agitator shaft that can be driven so as to rotate, having an axis, a last agitator disc of a diameter b' fixed on the agitator shaft and located adjacent to the grinding stock discharge port, and agitator discs of a diameter b fixed on the agitator shaft axially upstream of the last agitator disc at an axial distance a from one another, wherein adjacent upstream agitator discs define a separation angle $\alpha$ and the last agitator disc and the adjacent agitator disc define a separation angle $\beta$, wherein each separation angle $\alpha$, $\beta$, is formed by a line between a radially inward end of an agitator disc on the agitator shaft and the outer edge of an adjacent agitator disc and by a line that is parallel to the axis, and wherein the following applies: $30° < \alpha < 60°$, having passages formed in the last agitator disc adjacent to the agitator shaft that open into the separation device.

BACKGROUND OF THE INVENTION

An agitator mill of this type is known from EP 0 751 830 B1. In this agitator mill the distance between the last agitator disc, which carries the cage, and the adjacent agitator disc is significantly smaller than the distance of the remaining agitating discs from one another. The reason lies in that, between the agitator discs with the exception of the last agitator disc the distance is such in each case that so-called braided flows develop, i.e. adjacent to the agitator discs the grinding stock together with the auxiliary grinding bodies flows outward as a result of the tangential momenta applied by the agitator discs. In the middle region between the adjacent agitator discs the grinding stock and the auxiliary grinding bodies flow back toward the agitator shaft. In order for the aforementioned braided flows to be able to develop, the distance between adjacent agitator discs must be sufficiently great. This distance is also defined by a so-called separation angle, which is enclosed by two lines. One line extends between a radially inward end of a agitator disc on the agitator shaft. The other line extends parallel to the axis of the agitator shaft. In order for such braided flows to develop, the objective is for the separation angle to be between 30° and 60°. In order to attain a particularly good separation of the auxiliary grinding bodies from the grinding stock including the not yet sufficiently ground grinding stock particles, the distance between the last agitator disc and the adjacent agitator disc is significantly reduced, such that a preliminary screening takes place there upstream of the separation device. This is intended to achieve that at least a substantial portion of the auxiliary grinding bodies and of the coarse, not yet sufficiently ground grinding stock particles does not enter into the separation device in the first place, in which a secondary separation of the remaining auxiliary grinding bodies and coarse grinding stock particles then takes place. This has the disadvantage that these measures cause the active grinding chamber to be reduced in size and the total separation area to be enlarged.

SUMMARY OF THE INVENTION

This object is achieved according to the invention by $30° < \beta < 60°$ applying also to the separation angle $\beta$ between the last agitator disc and the adjacent agitator disc, and by the agitator disc being provided on its side facing the adjacent agitator disc with depressions. With the inventive measures it is achieved that an intense grinding and dispersion process takes place also between the last and the adjacent agitator disc, and the braided flows that are required for the process are formed in this region as well. This is caused by the recesses in the last agitator disc. The separation of the auxiliary grinding bodies and any coarse, insufficiently ground grinding stock particles takes place within the separation device under preceding tangential acceleration, during which process the auxiliary grinding bodies and any coarse, not yet sufficiently ground particles are substantially centrifuged off radially through the apertures in the cage, whereas finely ground and dispersed grinding stock is redirected within the cage and discharged through the screen.

This object is achieved according to the invention by the features in the characterizing part of claim 1. With the inventive measures it is achieved that an intense grinding and dispersion process takes place also between the last and the adjacent agitator disc, and the braided flows that are required for the process are formed in this region as well. This is caused by the recesses in the last agitator disc. The separation of the auxiliary grinding bodies and any coarse, insufficiently ground grinding stock particles takes place within the separation device under preceding tangential acceleration, during which process the auxiliary grinding bodies and any coarse, not yet sufficiently ground particles are substantially centrifuged off radially through the apertures in the cage, whereas finely ground and dispersed grinding stock is redirected within the cage and discharged through the screen.

Additional advantages, features and details of the invention will become apparent from the following description of embodiments with reference to the drawing.

DESCRIPTION OF THE PREFERRED EMBODIMENTS

Figure 1:
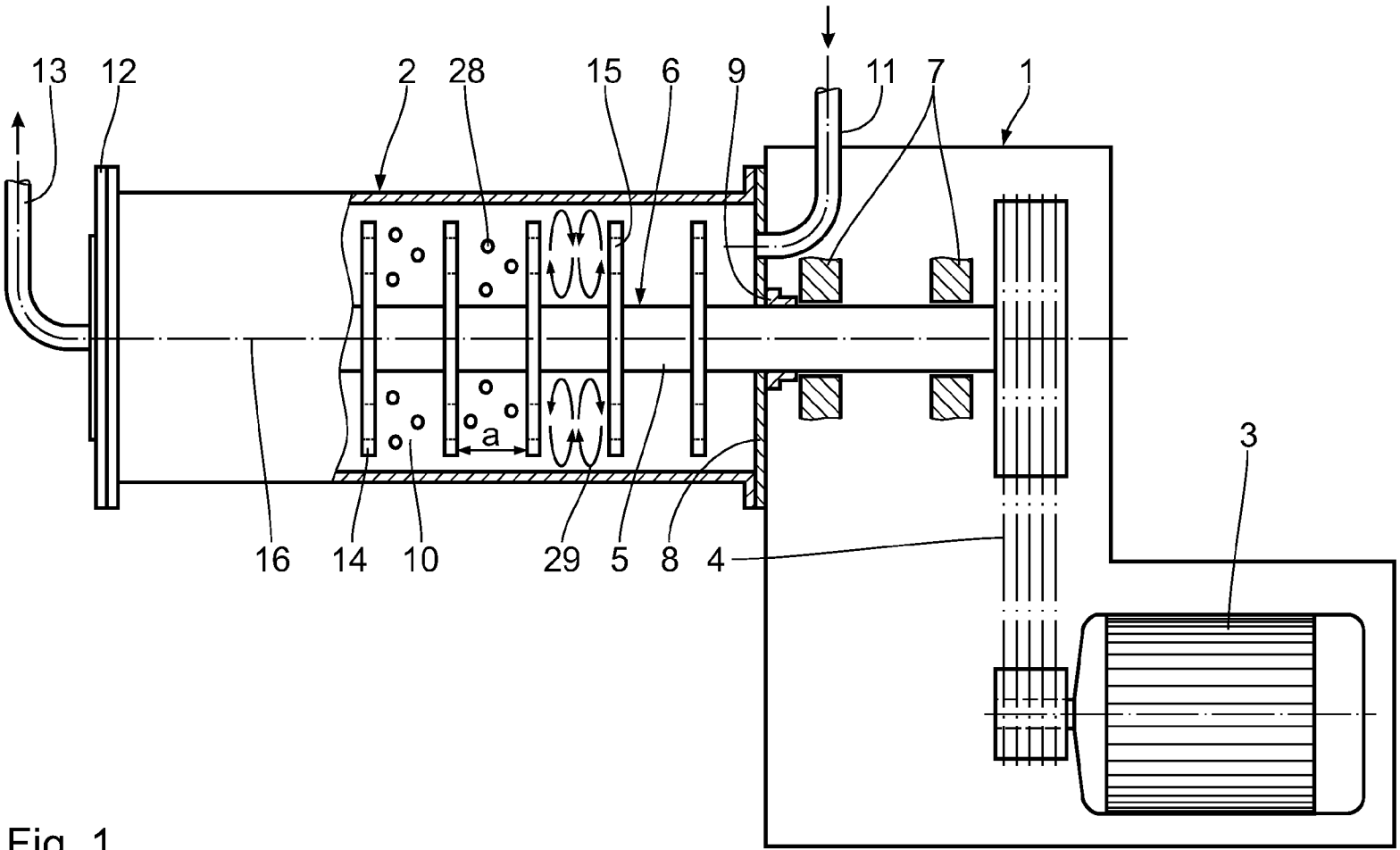
FIG. 1 shows an agitator mill in a schematic view in a side view in a partially cut-away view.

The agitator mill depicted in the drawing has a machine frame 1, on which a grinding vessel 2 is releasably mounted. Disposed in the machine frame 1 is a drive motor 3 that drives an agitator shaft 5 of an agitator 6 via a belt drive 4. The agitator shaft 5 is supported in the machine frame 1 in bearings 7 so as to be rotatable. In the grinding vessel 2 itself, specifically at its end opposite the machine frame 1, the agitator shaft 5 is not supported, i.e. it is supported cantilevered in the machine frame 1.

The grinding vessel 2 is sealed relative to the machine frame 1 by means of a cover 8 that is penetrated by the agitator shaft 5, wherein a seal is effected by means of a shaft seal 9. In the region of the cover 8 a grinding stock inlet 11 opens into the grinding chamber 10, which is enclosed by the grinding vessel 2. From the end of the grinding vessel 2 opposite the grinding stock inlet 11 a grinding stock discharge port 13 opens out from a bottom 12 that closes off the grinding chamber.

Fixed to the agitator shaft 5—as part of the agitator 6—are agitator implements or agitator tools respectively designed in the form of agitator discs 14, wherein the agitator discs have openings 15 in their outer peripheral region. The distances a between adjacent agitator discs 14 in the direction of the axis 16 of the agitator shaft 5 are identical in each case. Only the distance of the agitator disc 14 immediately adjacent to the cover 8 from the cover 8 is smaller than the distance a.

Figure 2:
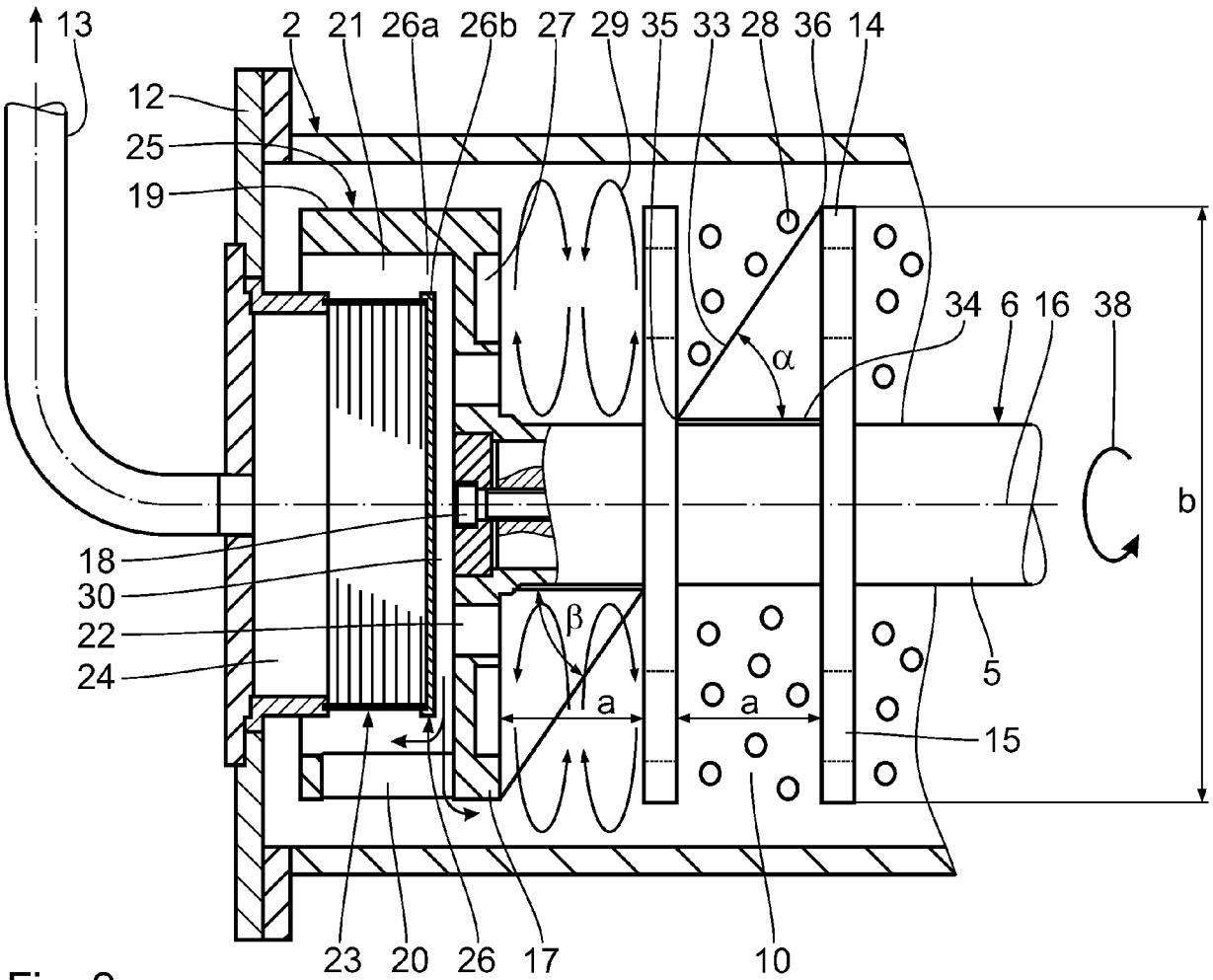
FIG. 2 shows a first embodiment of the outlet region of the agitator mill.

As can be seen from FIG. 2, the last agitator disc 17 of the agitator 6 adjacent to the bottom 12 is fastened by means of a fastening screw 18 to the agitator shaft 5. The axial distance a' of this agitator disc 17 from the adjacent second to last agitator disc 14 of the agitator 6 is identical to the aforementioned respective axial distances a between adjacent agitator discs 14. The diameters b of all stirring discs 14 and the diameter b' of the agitator disc 17 are identical as well.

Formed on the outer periphery of the last agitator disc 17 is a cylindrical cage 19 that can be designed integral with the last agitator disc 17. It has a multiplicity of apertures 20 distributed over its periphery. Passages 22 that are formed adjacent to the agitator shaft 5 in the last agitator disc 17 open into the separation chamber 21 that is enclosed by the agitator disc 17 and the cage 19.

Disposed in the separation chamber 21 on the bottom 12 concentrically to the axis 16 is a screening device 23. It is fastened to the bottom 12, specifically in a manner such that the screening device 23, after releasing thereof from the bottom 12 can be pulled out. It is thus connected to the grinding vessel 2 so as to not be rotatable. Opening out from the interior 24 of the screening device 23 is the grinding stock discharge port 13. The screening device 23 can be formed by annular discs that are disposed closely spaced on its cylindrical periphery in a known manner. The inside of the agitator disc 17, the cage 19 and the screening device 23 thus form a separation device 25. Adjacent to the agitator disc 17 the screening device 23 has a closed end plate 26. The interior 24 of the screening device 23 is thus connected to the separating chamber 21 only via the screening device 23.

Formed in the agitator disc 17—facing the nearest adjacent agitator disc 14—are depressions 27 or recesses respectively of identical shape as the openings 15 in the agitator discs 14 that have the same cross section as the openings 15 but do not lead into the separation chamber 21, i.e. the recesses 27 are closed on the side of the separation chamber 21. The depressions are situated radially outside of the passages 22.

The mode of operation is as follows:

During the operation, the grinding chamber 10 is filled to a substantial degree with auxiliary grinding bodies 28. Through the grinding stock inlet 11 flowable grinding stock is pumped continuously through the grinding chamber 10 by means of a pump that is not shown. During the operation, the agitator 6 is driven in a rotating manner by the drive motor 3. The grinding stock flows through the grinding chamber 10 toward the grinding stock outlet that is formed by the grinding stock discharge port 13. During this flow it is subjected to strong shear stresses by the auxiliary grinding bodies 28, as a result of which grinding stock particles are ground and the grinding stock is additionally homogenized. This process takes place in such a way that braided flows 29 develop between adjacent agitator discs 14, and 14 and 17, respectively, as shown in FIGS. 1 and 2. They can be explained in such a way that the grinding stock and the auxiliary grinding bodies 28 are subjected to stronger tangential momenta adjacent to the respective agitator discs 14, and 14 and 17, respectively, than in the middle region between two adjacent agitator discs 14. The result of this is that, adjacent to the agitator discs 14, and 14 and 17, respectively, auxiliary grinding bodies 28 and grinding stock flow more to the outside, whereas in the middle region between two adjacent agitator discs 14, and 14 and 17, respectively, they flow back inward toward the agitator shaft 5. This grinding and homogenizing process is identical between all agitator discs 14, and 14 and 17, respectively, because of their respective identical distances a and a' and their respective identical diameters b and b' and their identical number of rotations. The depressions 30 ensure that the described braided flow 29 is identical to the above-described braided flows 29 also between the last agitator disc 17' and the adjacent agitator disc 14.

Corresponding to the quantity of grinding stock flowing through the grinding chamber 10 per time unit, an axial flow through the grinding chamber 10 is superimposed on the braided flows 29. From the last braided flow 29 between the second to last agitator disc 14 and the agitator disc 17 partial flows of grinding stock and auxiliary grinding bodies 28 exit adjacent to the agitator shaft 5 through the passages 22 in the agitator disc 17 into the separating chamber 21 within the cage 19. The sum of these partial flows substantially corresponds to the volume flow of grinding stock that is fed in through the grinding stock inlet 11 and discharged through the grinding stock discharge port 13. The partial flows are redirected in the gap space 30 formed by the agitator disc 17 and the non-rotating end plate 26 to the outside radially to the axis 16 and accelerated tangentially. As a result of the rotating movement of the agitator disc 17 the grinding stock and the auxiliary grinding bodies 28 are again driven in the gap space 30 into an outwardly directed particularly high acceleration, which is true in particular for the auxiliary grinding bodies 28 and any potentially still remaining particularly coarse grinding stock particles. These grinding stock particles and the auxiliary grinding bodies 28 are centrifuged off to the outside through the apertures 20 of the cage 19. The auxiliary grinding bodies 28 and the coarse, not sufficiently ground grinding stock particles are thus returned into the braided flow 29. The grinding stock—to the extent that it is not centrifuged off through the cage 19—is redirected in the annular gap **26*a* between the outer periphery 26*b* of the end plate 26 and the cage 19 into an axial flow direction and discharged through the screening device 23. The separation of the auxiliary grinding bodies 28 and, if applicable, any large grinding stock particles accordingly takes place only within the separation device 25**.

Figure 3:
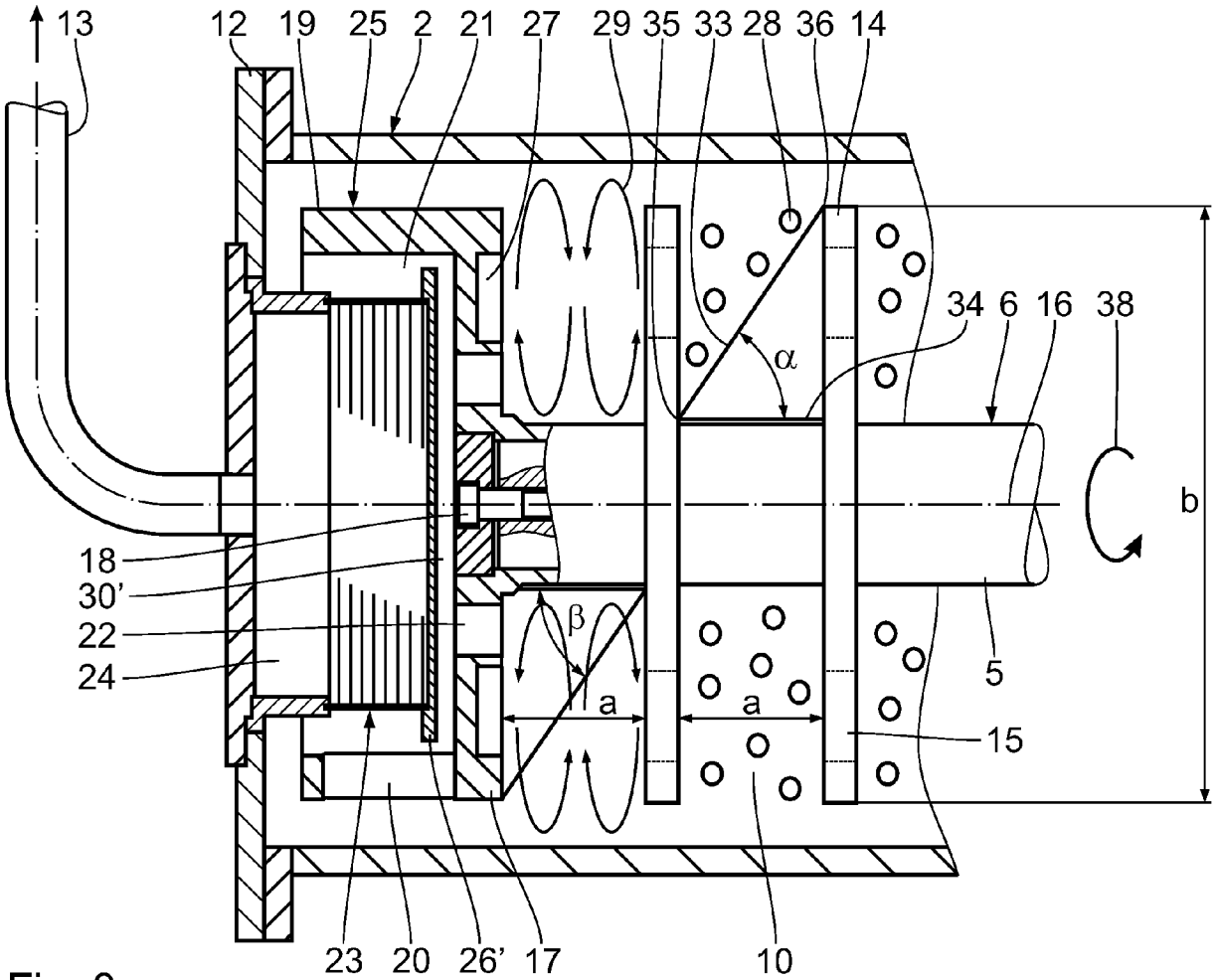
FIG. 3 shows a second embodiment of the outlet region of the agitator mill.

The embodiment according to FIG. 3 differs from the above-described embodiment in that the end plate 26' extends radially beyond the screening device 23 into the vicinity of the cage 19, such that the gap space 30' approaches the cage 19 more closely.

Figure 4:
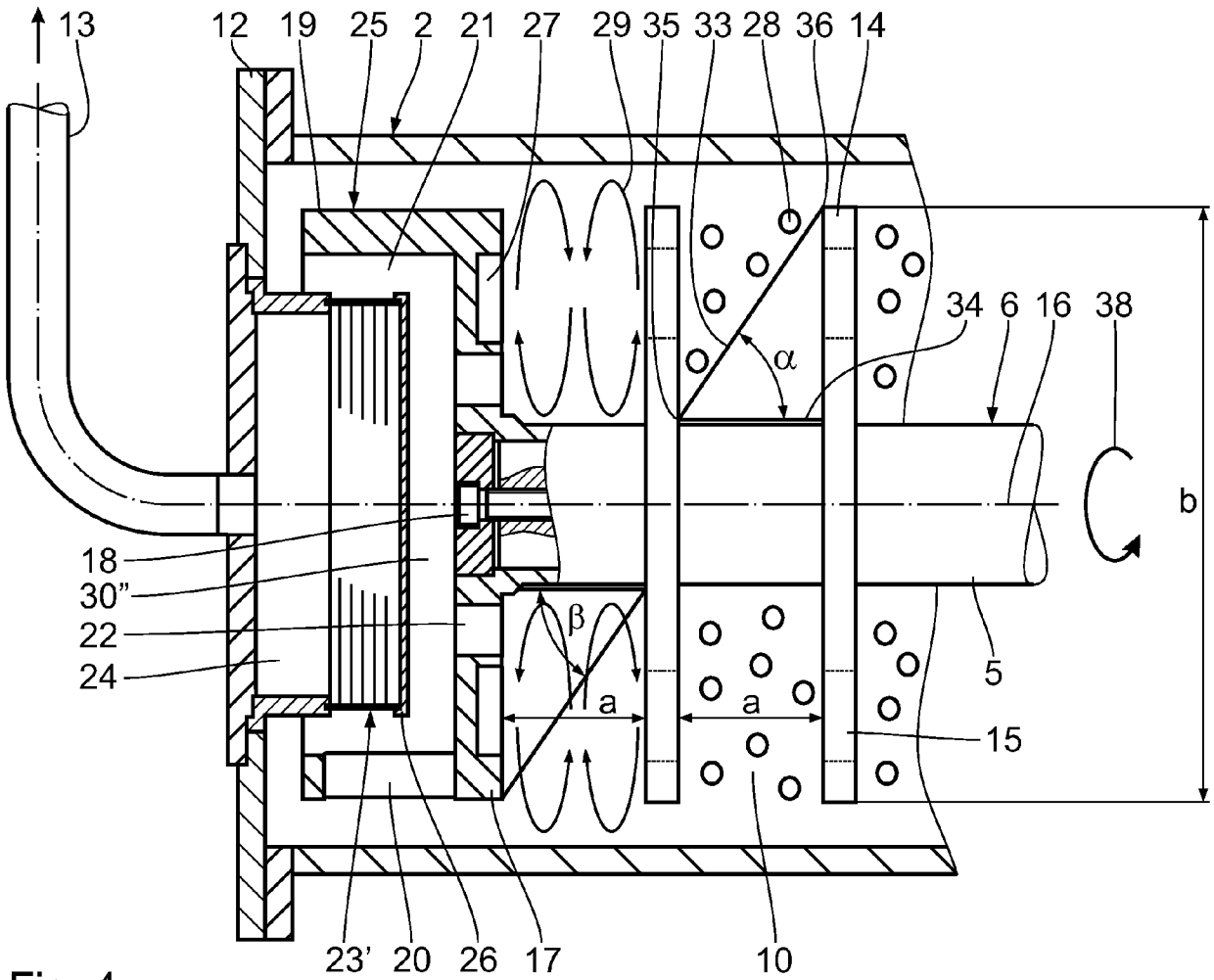
FIG. 4 shows a third embodiment of the outlet region of the agitator mill.

The embodiment according to FIG. 4 differs from that of FIG. 2 in that the screening device 23' has a lesser axial extension than in the above-described embodiments, such that the gap space 30" has a greater axial width than in the previously described embodiments. As a result of this, the grinding stock together with the auxiliary grinding bodies 28 has already spent more time in the centrifugal field in the gap space 30", such that the grinding stock and the auxiliary grinding bodies 28 already have a pronounced radial velocity.

Figure 5:
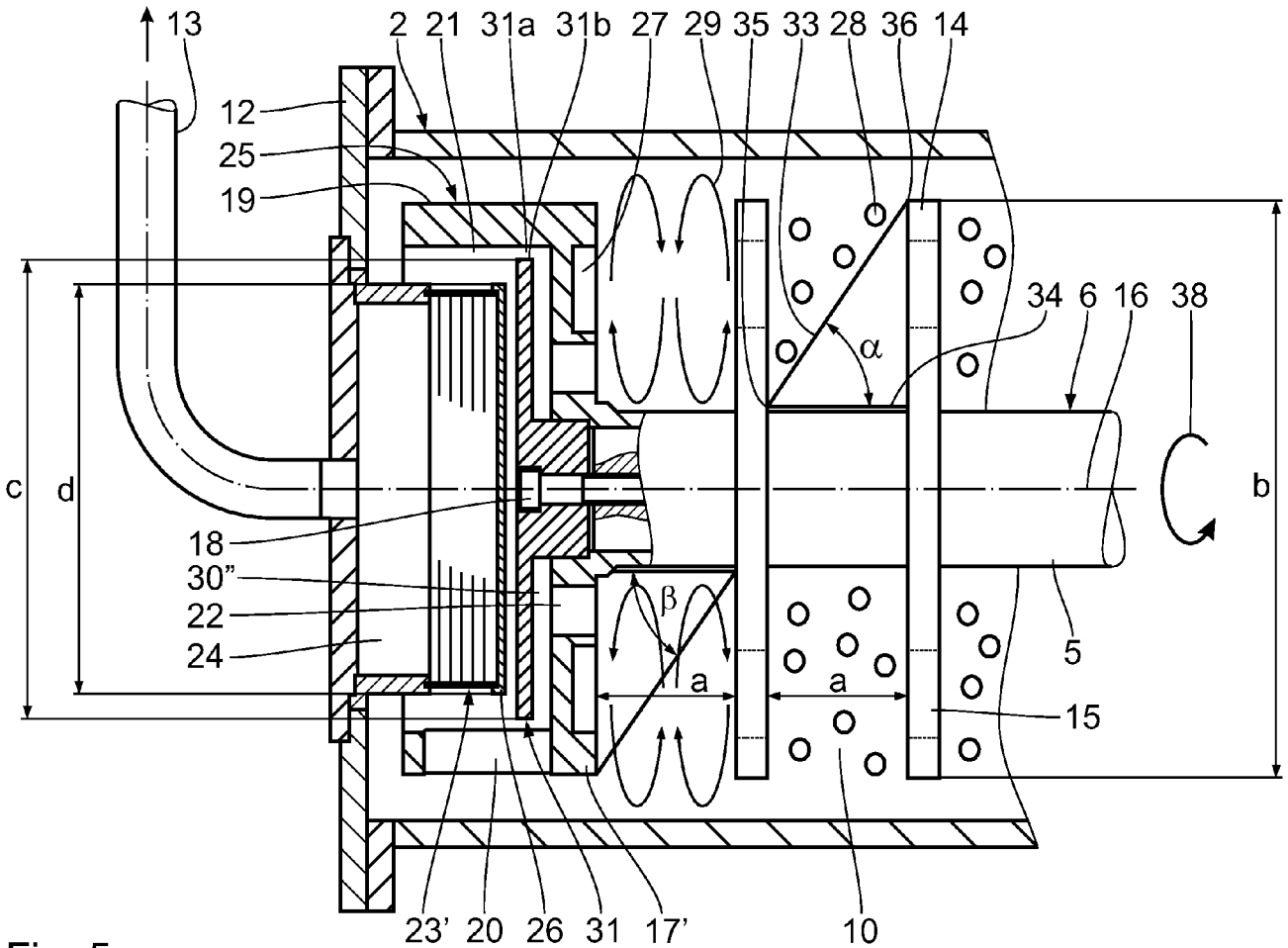
FIG. 5 shows a fourth embodiment of the outlet region of the agitator mill.

In the embodiment according to FIG. 5, the end plate 26 is disposed like in the embodiment according to FIG. 4; additionally an intermediate wall 31 is fixed on the agitator 6 between the agitator disc 17' and end plate 26, said intermediate wall rotating with the agitator 6 and bounding a gap space 30" in which the mixture of grinding stock and auxiliary grinding bodies 28 is accelerated radially outward to a greater degree than is the case in the above described embodiments.

Figure 6:
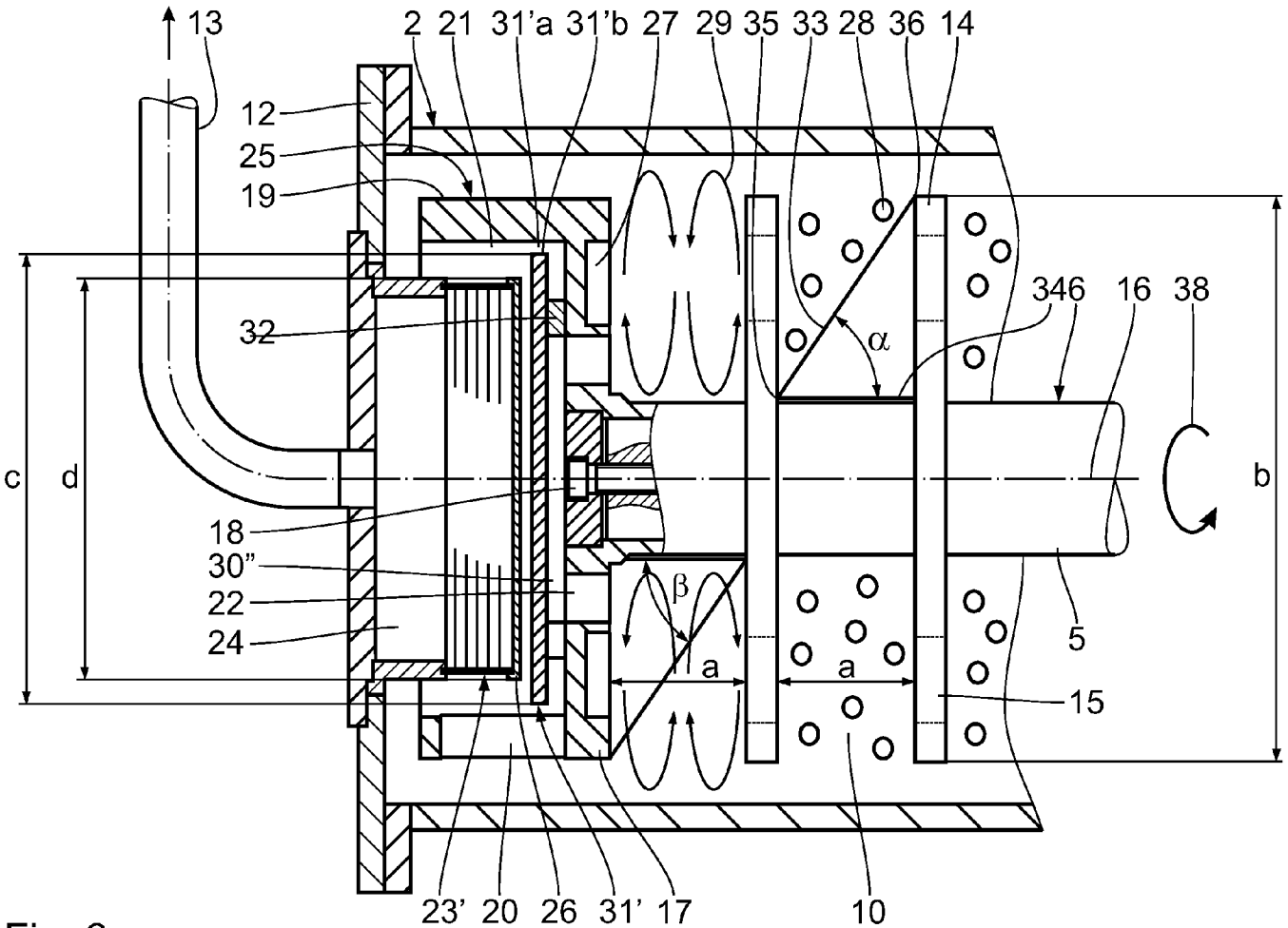
FIG. 6 shows a fifth embodiment of the outlet region of the agitator mill.

While this intermediate wall 31 in the embodiment according to FIG. 5 is fastened to the agitator shaft 5 by means of the fastening screw 18, the intermediate wall 31' in the embodiment according to FIG. 6 is fixed directly to the agitator disc 17 by means of wing-like spacers 32 that are distributed about the periphery. The intermediate walls 31 and 31', respectively, each extend radially at least beyond the end plate 26; such that $c \geqq d$, where c is the diameter of the intermediate wall 31 or 31', respectively, and d is the diameter of the end plate 26. Preferably $c>d$, where the corresponding intermediate wall 27' extends to within a close distance from the cage 19. Since the intermediate wall 31 and 31', respectively, rotates along with the agitator disc 17, 17', the acceleration of the grinding stock and of the auxiliary grinding bodies 28 is particularly high in this case.

In the embodiments according to FIGS. 5 and 6, the ground grinding stock—to the extent that it is not centrifuged off through the cage 19—is redirected in the annular gap 31*a* or 31'*a*, respectively, between the outer periphery 31*b* or 31'*b* or intermediate wall 31 or 31' and cage 19 into an axial flow direction and discharged through the screening device 23.

For the explanation of the relevant correlations between the diameter b of the stirring discs 14, 17, 17' and their axial distance a, a' for the development of the braided flows 29, it should be noted that a so-called separation angle $\alpha$ or $\beta$ is being used for definition purposes. The separation angle $\alpha$ or $\beta$ is formed between two lines 33 and 34. The line 33 extends from the inward end 35 of an agitator disc 14 on the agitator shaft 5 to the outer edge 36 of an adjacent agitator disc 14. The other line 34 is a line that is parallel to the axis 16. The separation angle $\beta$ is the one between the last agitator disc 17 or 17' respectively, and the nearest adjacent agitator disc 14. In order for said braided flows 32 to develop, the following applies for the separation angle:

$30° < \alpha < 60°$ and $30° < \beta < 60°$. In other words, this means that the separation angle $\beta$ between the last agitator disc 17 or 17', and the nearest adjacent agitator disc 14 also is such that said braided flows 29 develop even in the event that the distances a and a' are not identical.

Although agitator mills having a horizontal axis 16 were described in each of the presented embodiments, the invention is also applicable, of course, in agitator mills having a vertical axis.

Figure 8:
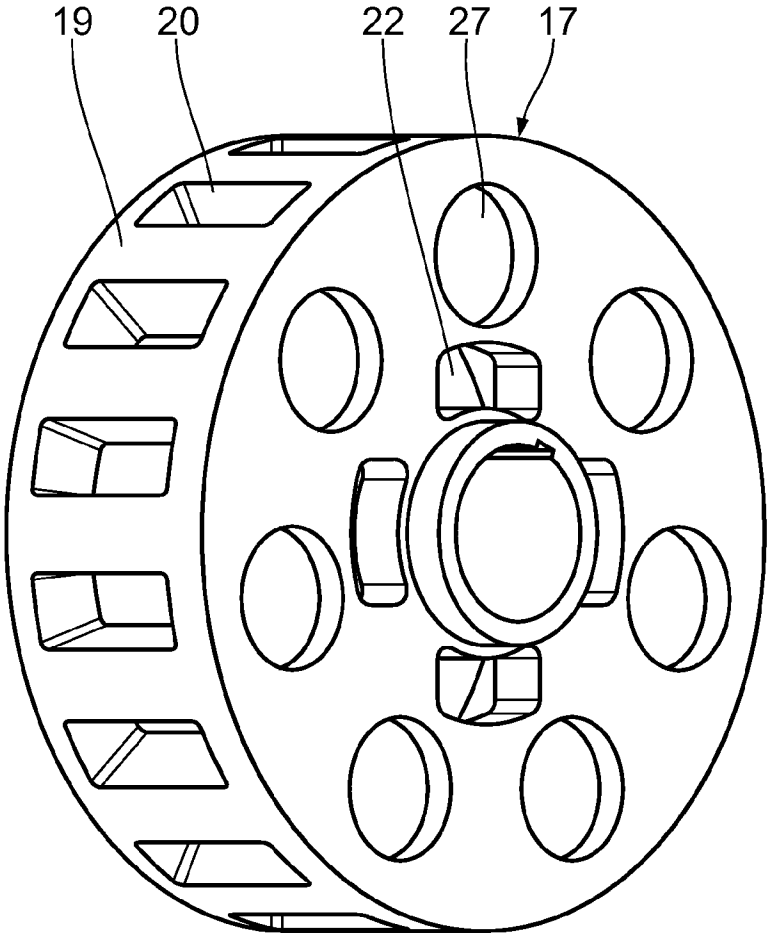
FIG. 8 shows a last agitator disc with a cage in a perspective view.
Figure 7:
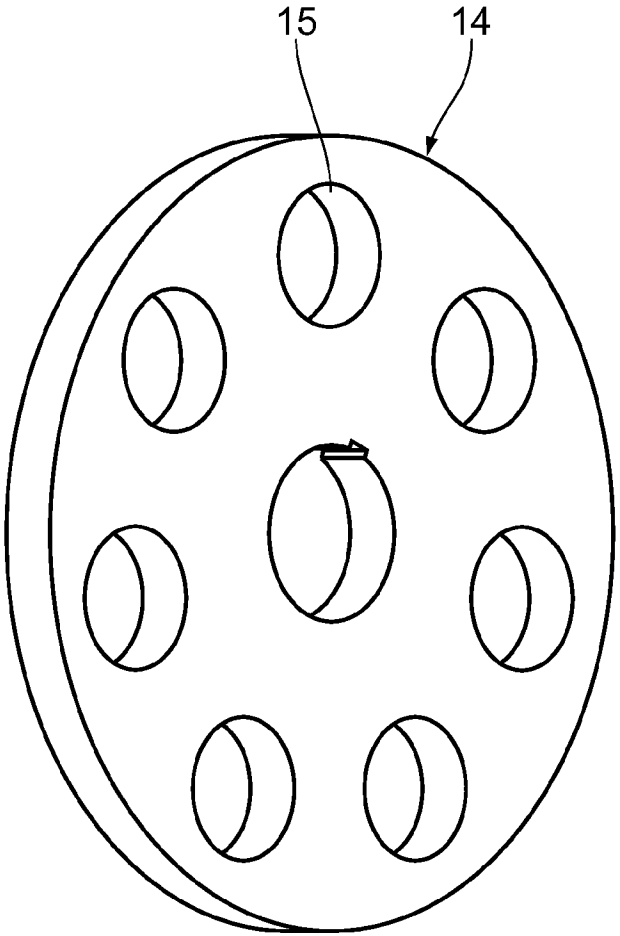
FIG. 7 shows an agitator disc in a perspective view.

The openings 15 in the agitator discs 14 can—as can be seen from FIG. 7—have a circular cross section. The depressions 27 in the agitator disc 17 are accordingly designed circularly as shown in FIG. 8.

Figure 10:
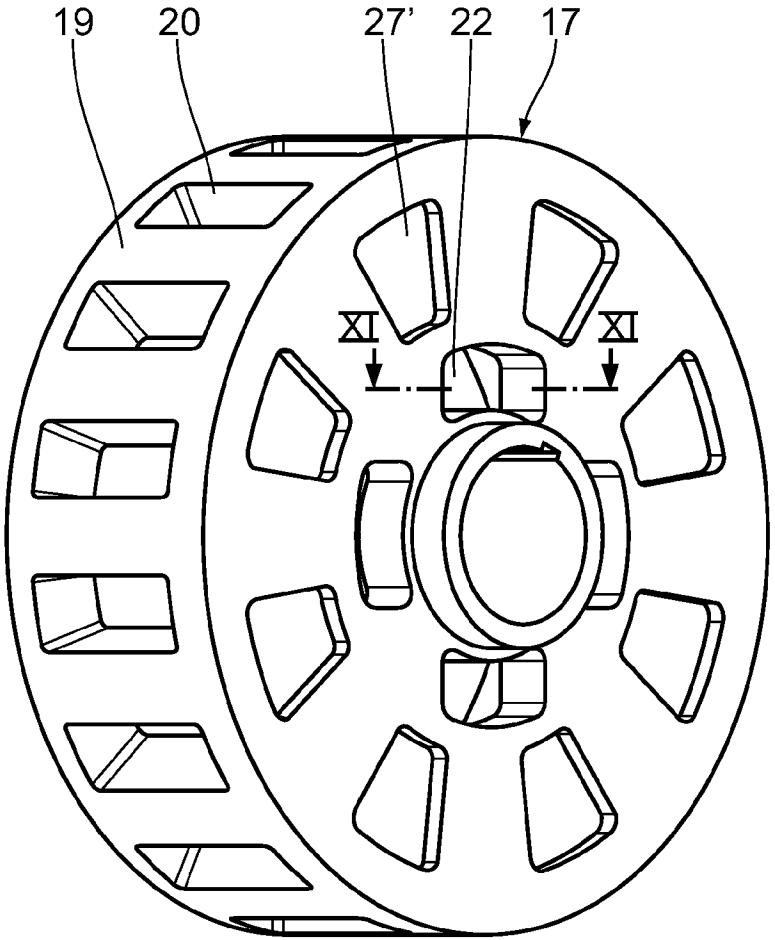
FIG. 10 shows an additional embodiment of a last agitator disc with a cage in a perspective view.
Figure 9:
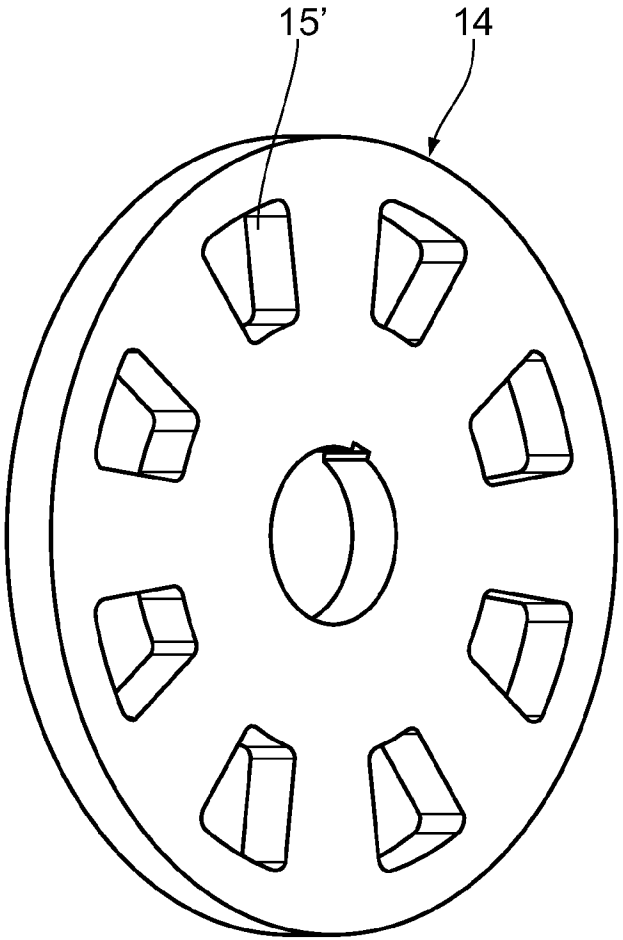
FIG. 9 shows an additional embodiment of an agitator disc.

According to FIG. 9 the openings 15' in the agitator discs 14 can have approximately the cross section of outwardly widening trapezoids. The same is true for the recesses 27' in the corresponding agitator disc 17, as can be seen from FIG. 10.

Figure 11:
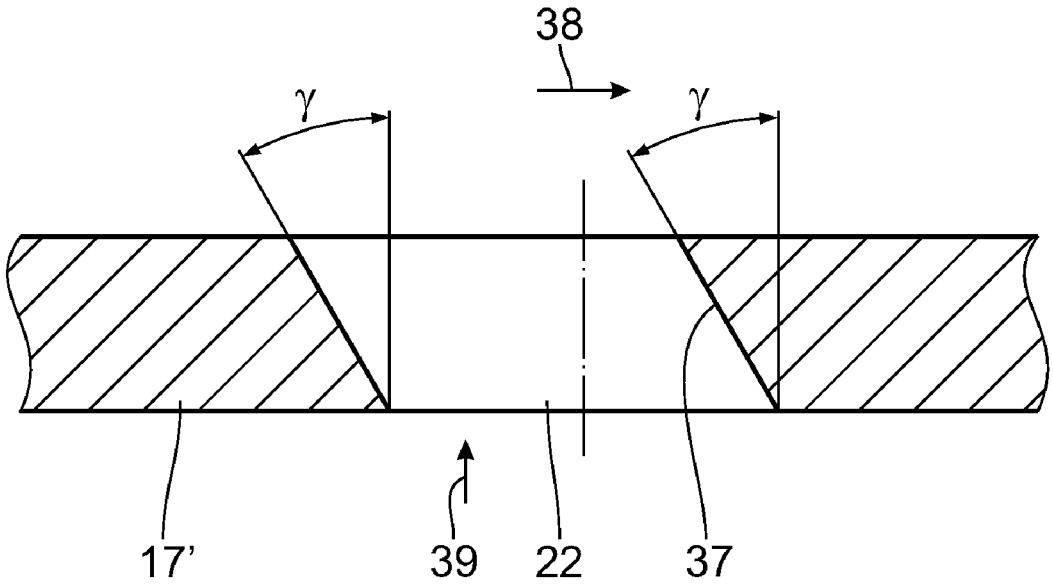
FIG. 11 shows a partial section through the last agitator disc along the section line XI-XI in FIG. 10.

Lastly, the passages 22 in the agitator discs 17, 17' can be designed actively conveying, as it is shown only in FIG. 11. The walls 37 of the passages in this case do not extend parallel to the axis 16 but are angled against the direction of rotation 38 and in the flow direction 39—that is in the direction toward the end plate 26 or 26', or toward the intermediate wall 31—trailing by an angle $\gamma$ relative to a line parallel to the axis 16. As a result of this, the grinding stock and the auxiliary grinding bodies 28 are drawn into the passages 22 and pushed through same into the gap space 30 with particular intensity. The sum of the above mentioned partial flows therefore in fact corresponds to approximately the total volume flow of grinding stock that is fed in through the grinding stock inlet 11 and discharged through the grinding stock discharge port 13, wherein in this region, because of the existing braided flow 29, the normal concentration of auxiliary grinding bodies 28 is present in the grinding stock, which are also transported along through the passages 22. In the above-described embodiment the following applied for the angle $\gamma$: $\gamma=0°$. For practical embodiments of actively conveying passages 22 the following applies: $0° < \gamma < 45°$.

The invention claimed is:

1. An agitator mill
comprising a grinding vessel (2)
that encloses a grinding chamber (10),
into which a grinding stock inlet (11) opens at one end and
from which a grinding stock discharge port (13) opens out at the other end,
having an agitator (6) arranged in the grinding chamber (10), said agitator (6) having
an agitator shaft (5) that can be driven so as to rotate, having an axis (16),
a last agitator disc (17, 17') of a diameter b' fixed on the agitator shaft (5) and located adjacent to the grinding stock discharge port (13), and
agitator discs (14) of a diameter b fixed on the agitator shaft (5) axially upstream of the last agitator disc (17, 17') at an axial distance a from one another,
wherein adjacent upstream agitator discs (14) define a separation angle $\alpha$ and the last agitator disc (17, 17') and the adjacent agitator disc (14) define a separation angle $\beta$,
wherein each separation angle $\alpha$, $\beta$, is formed by a line (33) between a radially inward end (35) of an agitator disc (14, 17, 17') on the agitator shaft (5) and the outer edge (36) of an adjacent agitator disc (14) and by a line (34) that is parallel to the axis (16), and
wherein $30° < \alpha < 60°$,
and having passages (22) formed in the last agitator disc (17, 17') adjacent to the agitator shaft (5) that open into the separation device (25),
wherein $30° < \beta < 60°$ applies also to the separation angle $\beta$ between the last agitator disc (17, 17') and the adjacent agitator disc (14), and
wherein the last agitator disc (17, 17') is provided on its side facing the adjacent agitator disc (14) with depressions (27).

2. An agitator mill according to claim 1, wherein the depressions (27) are formed radially outside of the passages (22) in the last agitator disc (17, 17').

3. An agitator mill according to claim 1, wherein the agitator discs (14) fixed on the agitator shaft (5) axially upstream of the last agitator disc (17, 17') are provided with openings (15), and wherein the depressions (27) are of identical cross section as the openings (15).

4. An agitator mill according to claim 1, wherein the diameters b of all agitator discs (14, 17, 17') are identical.

5. An agitator mill according to claim 1, wherein the distance a' of the last stirring disc (17, 17') from the immediately adjacent agitator disc (14) is identical to the distance a of all downstream agitator discs (14) from one another.

6. An agitator mill according to claim 1, wherein the diameters b, b' of all agitator discs (14, 17) are identical.

7. An agitator mill according to claim 1, wherein in the direction of rotation (38), the passages (22) are designed so as to trail the agitator shaft (5) toward the screening device (23).

* * * * *